US009073193B2

(12) United States Patent
Zeng

(10) Patent No.: US 9,073,193 B2
(45) Date of Patent: Jul. 7, 2015

(54) C-TYPE PLIERS

(71) Applicant: Min-Zheng Zeng, Nantou (TW)

(72) Inventor: Min-Zheng Zeng, Nantou (TW)

( * ) Notice: Subject to any disclaimer, the term of this patent is extended or adjusted under 35 U.S.C. 154(b) by 198 days.

(21) Appl. No.: 13/928,374

(22) Filed: Jun. 26, 2013

(65) Prior Publication Data

US 2015/0000478 A1 Jan. 1, 2015

(51) Int. Cl.
*B25B 27/20* (2006.01)
*B25B 7/04* (2006.01)
*B25B 7/08* (2006.01)

(52) U.S. Cl.
CPC ..... *B25B 27/205* (2013.01); *B25B 7/04* (2013.01); *B25B 7/08* (2013.01)

(58) Field of Classification Search
CPC ..... B25B 27/20; B25B 27/205; B25B 7/04; B25B 7/08
USPC ..... 81/423, 302
See application file for complete search history.

(56) References Cited

U.S. PATENT DOCUMENTS

| | | | | |
|---|---|---|---|---|
| 5,483,732 | A * | 1/1996 | Wang | 29/229 |
| 7,032,479 | B1 * | 4/2006 | Wang | 81/302 |
| 7,055,413 | B1 * | 6/2006 | Wang | 81/302 |
| 7,497,150 | B1 * | 3/2009 | Huang | 81/423 |
| 7,712,398 | B2 * | 5/2010 | Chuang | 81/423 |
| 2011/0214538 | A1 * | 9/2011 | Huang | 81/302 |

* cited by examiner

*Primary Examiner* — David B Thomas

(57) ABSTRACT

A C-type pliers contains a body, two positioning members, and two working shafts. The body is comprises of two clamping handles pivoted together so as to form a pressing end and a working end, the two clamping handles have the two working shafts, and each clamping handle has a hole communicating with an orifice of the clamping handle. Each working shaft includes a recessed neck, and each positioning member includes a peg pivoted in the hole, and the peg has an arcuate fixing section driven by the peg which is rotated so as to insert into the orifice and to retain with the recessed neck of the each working shaft. The peg has a flat releasing section, such that when the peg is rotated so that the flat releasing section faces to the recessed neck of the each working shaft, the each working shaft is released from the peg.

4 Claims, 5 Drawing Sheets

C-TYPE PLIERS

FIELD OF THE INVENTION

The present invention relates to a C-type pliers in which the each working shaft is replaced easily without using a tool, such as a screwdriver.

BACKGROUND OF THE INVENTION

A conventional C-type pliers is disclosed in TW Patent No. 1352007 and contains two clamping portions and a central shaft, wherein each clamping portion includes a hole defined therein and a clamp head away from the hole, the each clamping portion also includes a slot, and a distance between the hole and the each clamp head is within a distance between two ends of the lot and the clamp head. The central shaft is inserted into two holes of the two clamping portions so that two clamp heads of the two clamping portions swing between an engaging position and an expanding position, and the two heads are removably fixed on the two clamping portions.

However, the two clamp heads and the two clamping portions are locked by ways of screws, so when replacing the two clamping portions, the screws are unscrewed and then screwed on the two clamp heads and the two clamping portions, thus having troublesome replacement.

The present invention has arisen to mitigate and/or obviate the afore-described disadvantages.

SUMMARY OF THE INVENTION

The primary object of the present invention is to provide a C-type pliers is capable of overcoming the shortcomings of the conventional C-type pliers thereof.

To obtain the above objective, a C-type pliers provided by the present invention contains:

a body, two positioning members, and two working shafts, wherein the body is comprises of two clamping handles pivoted together so as to form a pressing end and a working end opposite to the pressing end, the two clamping handles have the two working shafts inserted therein and located at the working end, and each clamping handle has a hole defined therein and perpendicularly communicating with an orifice on a top end of the clamping handle;

each working shaft includes a recessed neck formed on a lower side thereof so that when the working shaft is inserted into the orifice, the recessed neck corresponds to a portion at which the hole communicates with the orifice;

each positioning member includes a peg pivoted in the hole, and the peg has an arcuate fixing section arranged around a part of an outer peripheral side thereof and driven by the peg which is rotated so as to insert into the orifice and to retain with the recessed neck of the each working shaft, thus retaining the each working shaft with the peg; the peg has a flat releasing section defined on another part of the outer peripheral side thereof, such that when the peg is rotated so that the flat releasing section faces to the recessed neck of the each working shaft, the each working shaft is released from the peg.

Preferably, the each positioning member has at least one anti-slip rib arranged thereon so as to rotate the each clamping handle outwardly and to replace the each working shaft.

Preferably, the each working shaft is polygonal except the recessed neck, and the orifice is polygonal so as to correspond to a shape of the each working shaft, such that the each working shaft is retained in the orifice securely without rotation.

Thereby, the each working shaft is replaced easily without using a tool, such as a screwdriver.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
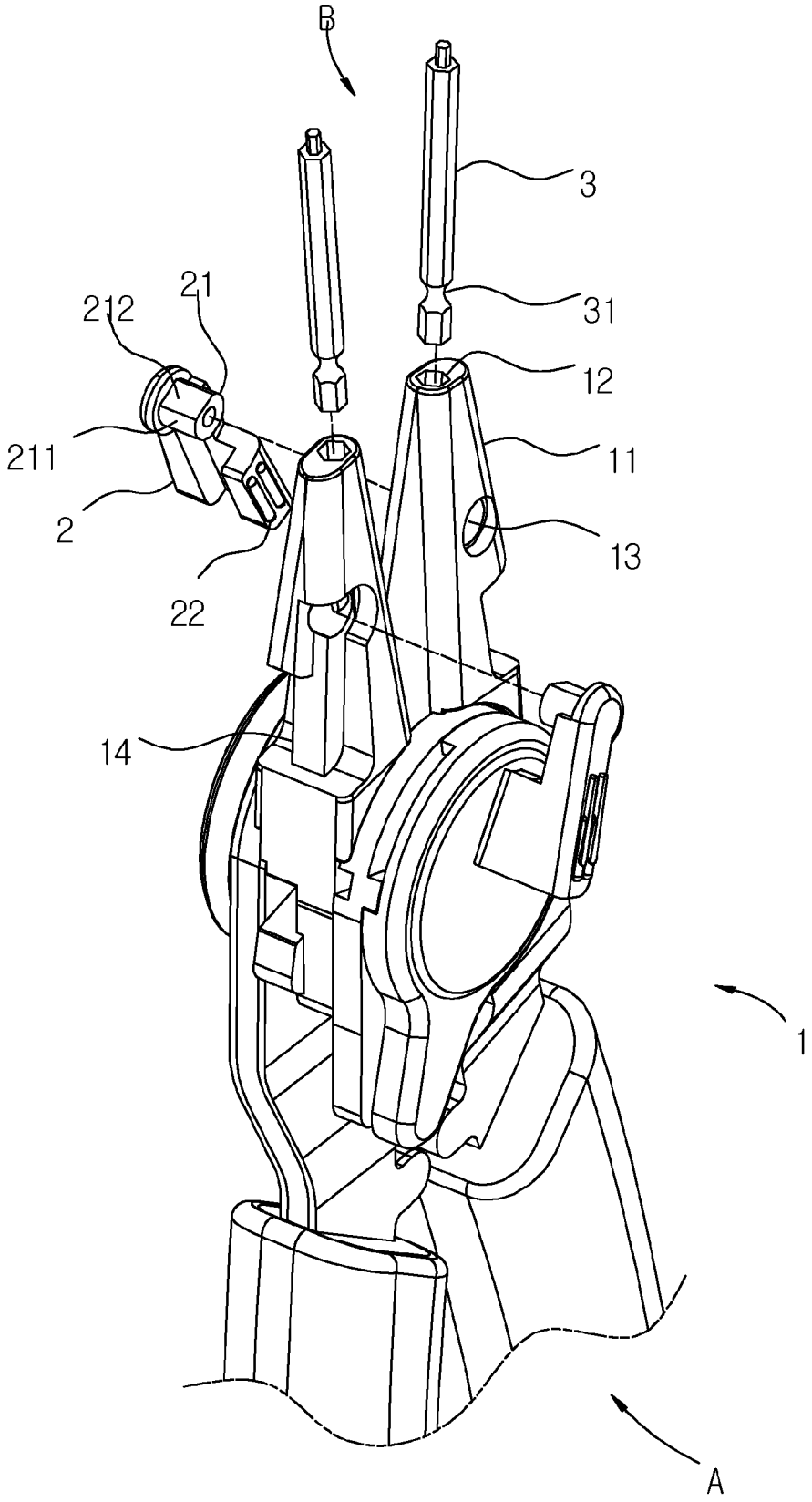
FIG. 1 is a perspective view showing the exploded components of a C-type pliers according to a preferred embodiment of the present invention.

With reference to FIGS. 1-7, a C-type pliers according to a preferred embodiment of the present invention comprises a body 1, two positioning members 2, and two working shafts 3.

The body 1 is comprises of two clamping handles 11 pivoted together so as to form a pressing end A and a working end B opposite to the pressing end A, the two clamping handles 11 have the two working shafts 3 inserted therein and located at the working end B, each clamping handle 11 has a hole 13 defined therein and perpendicularly communicating with an orifice 12 on a top end of the clamping handle 11.

Each working shaft 3 includes a recessed neck 31 formed on a lower side thereof so that when the working shaft 3 is inserted into the orifice 12, the recessed neck 31 corresponds to a portion at which the hole 13 communicates with the orifice 12.

Each positioning member 2 includes a peg 21 pivoted in the hole 13, and the peg 21 has an arcuate fixing section 211 arranged around a part of an outer peripheral side thereof and driven by the peg 21 which is rotated so as to insert into the orifice 12 and to retain with the recessed neck 31 of the each working shaft 3, thus retaining the each working shaft 3 with the peg 21. Also, the peg 21 has a flat releasing section 212 defined on another part of the outer peripheral side thereof, such that when the peg 21 is rotated so that the flat releasing section 212 faces to the recessed neck 31 of the each working shaft 3, the each working shaft 3 is released from the peg 21.

Figure 2:
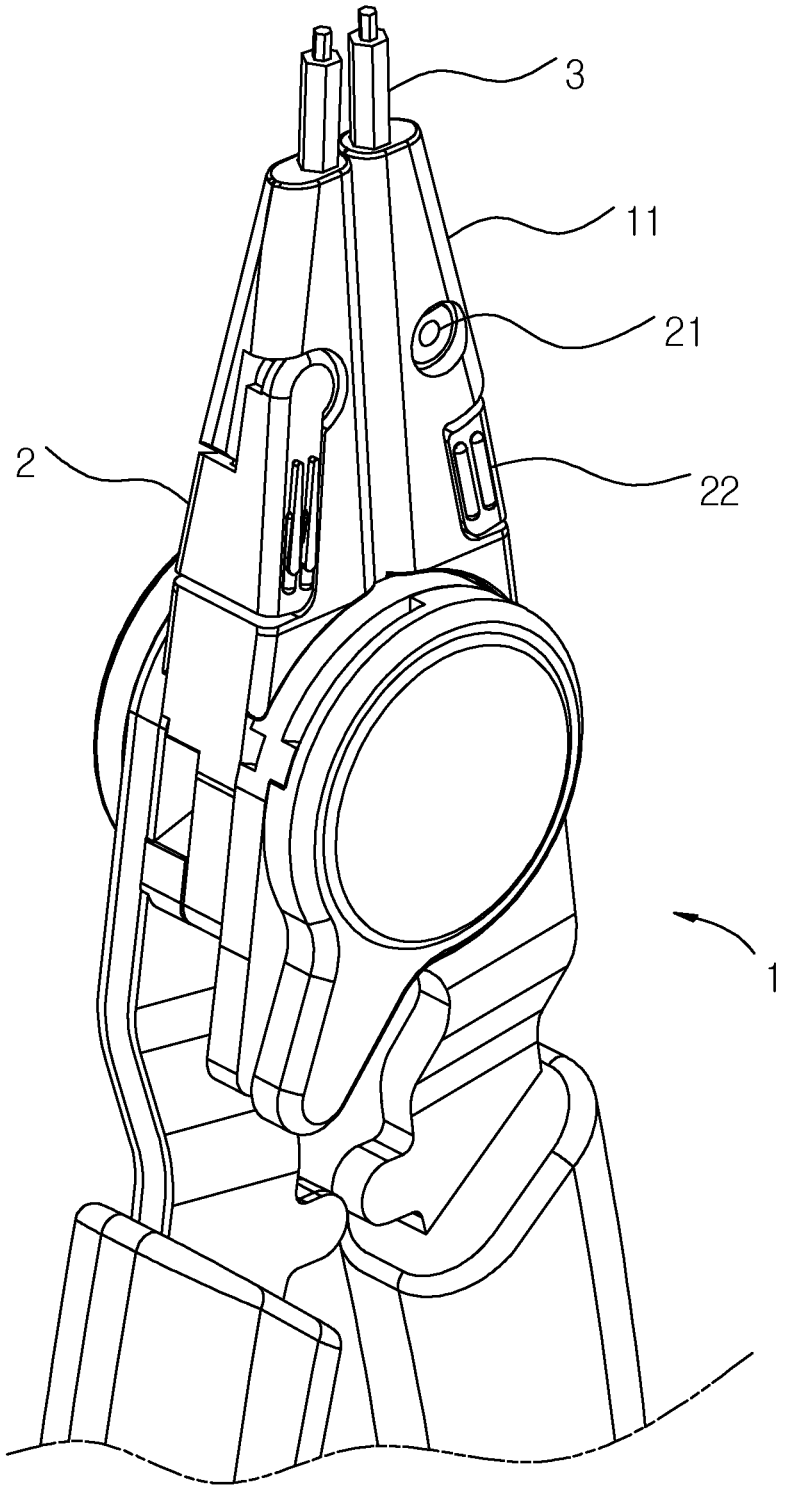
FIG. 2 is a perspective view showing the assembly of the C-type pliers according to the preferred embodiment of the present invention.
Figure 3:
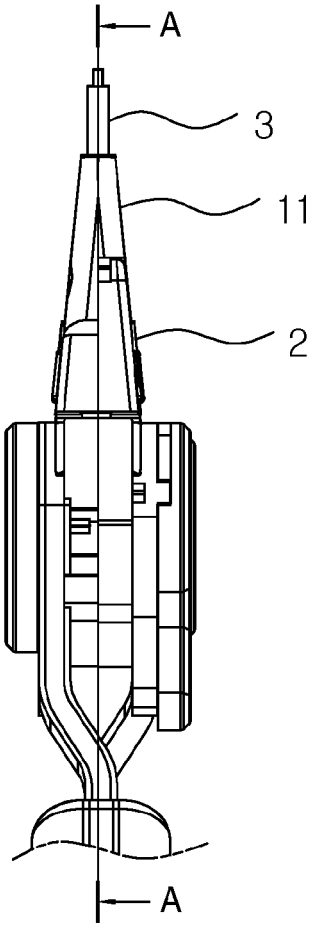
FIG. 3 is a plan view showing the assembly of the C-type pliers according to the preferred embodiment of the present invention.
Figure 4:
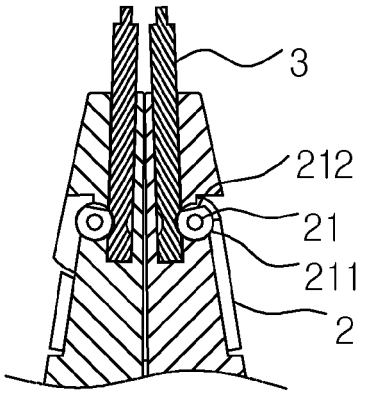
FIG. 4 is a cross sectional taken along the line A-A of FIG. 3 and showing the operation of the C-type pliers according to the preferred embodiment of the present invention.
Figure 5:
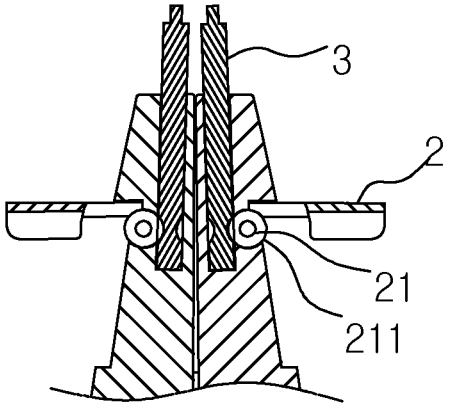
FIG. 5 is another cross sectional taken along the line A-A of FIG. 3 and showing the operation of the C-type pliers according to the preferred embodiment of the present invention.
Figure 6:
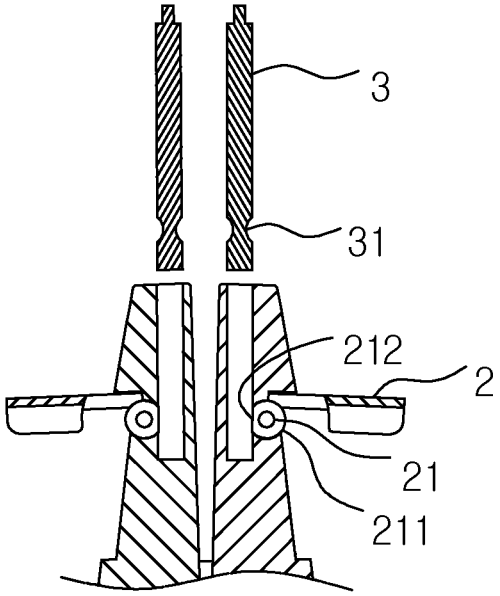
FIG. 6 is also another cross sectional taken along the line A-A of FIG. 3 and showing the operation of the C-type pliers according to the preferred embodiment of the present invention.
Figure 7:
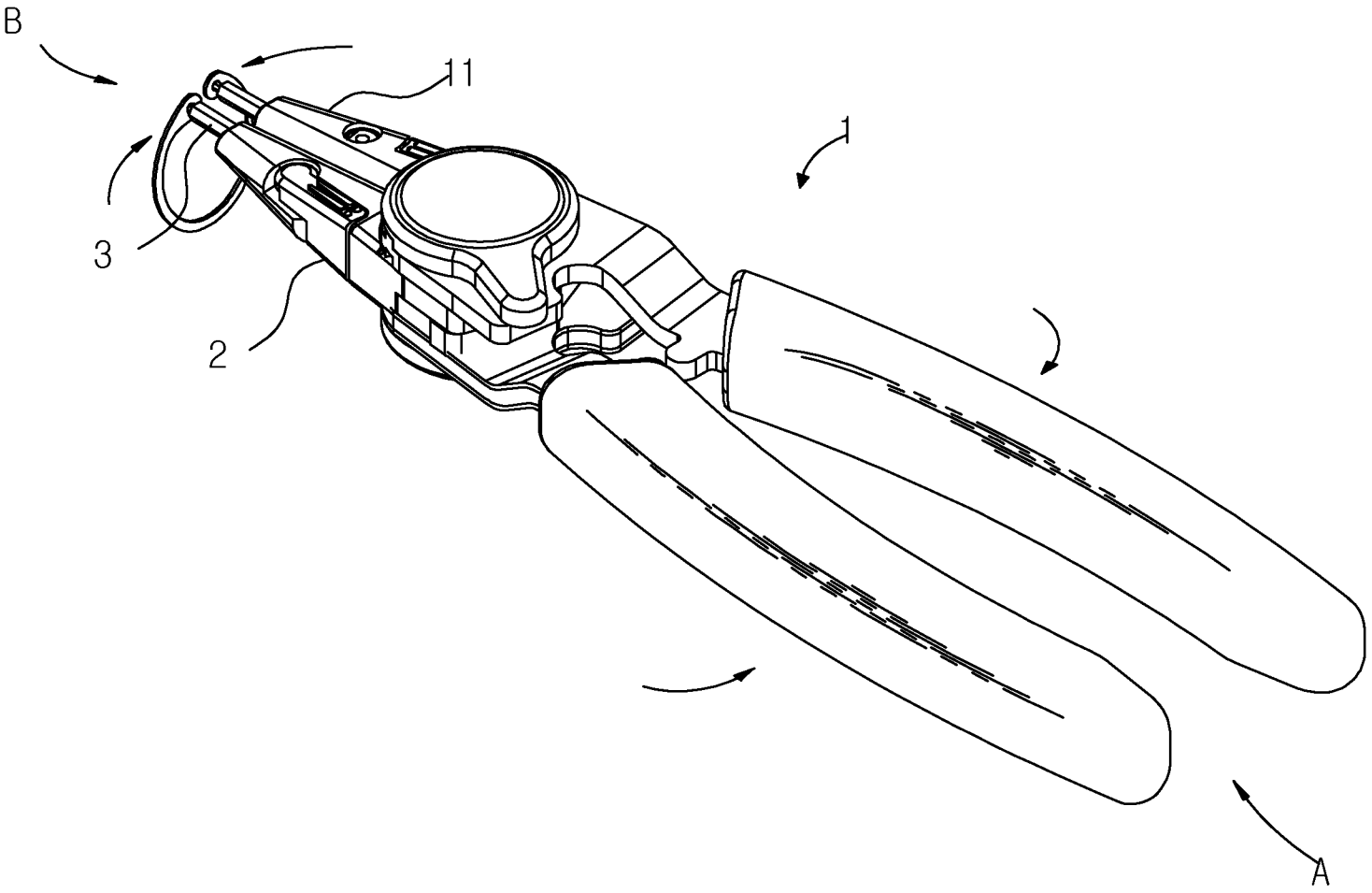
FIG. 7 is a perspective view of showing the operation of the C-type pliers according to the preferred embodiment of the present invention.

As shown in FIGS. 2 to 4, the fixing section 211 of the peg 21 is served to position the each working shaft 3 in the each clamping handle 11 securely. Referring further to FIG. 5, the each working shaft 3 with a varying size for being replaced and operated based on using requirement. For example, as replacing another working shaft 3 with a varying size into the orifice 12, the each positioning member 2 is rotated so that the flat releasing section 212 faces to the recessed neck 31 of the each working shaft 3, thus releasing the each working shaft 3 so as to replace the another working shaft 3 with a varying size.

In addition, the each clamping handle 11 has a dented portion 14 corresponding to the each positioning member 2 so as to contact with the each positioning member 2 after the positioning member 2 is retracted back to the each clamping handle 11, thus preventing the each positioning member 2 from interfering an operation of the C-type pliers.

It is to be noted that when the each positioning member 2 is retracted back to the dented portion 14 of the each clamping handle 11, the fixing section 211 of the peg 21 retains with the recessed neck 31 of the each working shaft 3, and after the each positioning member 2 is moved away from the dented portion 14 of the each clamping handle 11, the flat releasing section 212 faces to the recessed neck 31 of the each working shaft 3.

Preferably, the each positioning member 2 has at least one anti-slip rib 22 arranged thereon so as to rotate the each clamping handle 11 outwardly and to replace the each working shaft 3.

Preferably, the each working shaft 3 is polygonal except the recessed neck 31, and the orifice 12 is polygonal so as to correspond to a shape of the each working shaft 3, such that the each working shaft 3 is retained in the orifice 12 securely without rotation.

Thereby, the each working shaft 3 is replaced easily without using a tool, such as a screwdriver.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A C-type pliers comprising a body, two positioning members, and two working shafts, wherein the body is comprises of two clamping handles pivoted together so as to form a pressing end and a working end opposite to the pressing end, the two clamping handles have the two working shafts inserted therein and located at the working end, and each clamping handle has a hole defined therein and perpendicularly communicating with an orifice on a top end of the clamping handle;

each working shaft includes a recessed neck formed on a lower side thereof so that when the working shaft is inserted into the orifice, the recessed neck corresponds to a portion at which the hole communicates with the orifice;

each positioning member includes a peg pivoted in the hole, and the peg has an arcuate fixing section arranged around a part of an outer peripheral side thereof and driven by the peg which is rotated so as to insert into the orifice and to retain with the recessed neck of the each working shaft, thus retaining the each working shaft with the peg; the peg has a flat releasing section defined on another part of the outer peripheral side thereof, such that when the peg is rotated so that the flat releasing section faces to the recessed neck of the each working shaft, the each working shaft is released from the peg.

2. The C-type pliers as claimed in claim 1, wherein the each clamping handle has a dented portion corresponding to the each positioning member so as to contact with the each positioning member after the positioning member is retracted back to the each clamping handle.

3. The C-type pliers as claimed in claim 2, wherein when the each positioning member is retracted back to the dented portion of the each clamping handle, the fixing section of the peg retains with the recessed neck of the each working shaft, and after the each positioning member is moved away from the dented portion of the each clamping handle, the flat releasing section faces to the recessed neck of the each working shaft.

4. The C-type pliers as claimed in claim 1, wherein the each positioning member has at least one anti-slip rib arranged thereon.

* * * * *